United States Patent [19]

Gandia

[11] 4,084,026

[45] Apr. 11, 1978

[54] METHOD OF EMBOSSING TEXTILE MATERIAL

[75] Inventor: Manuel Taberner Gandia, Onteniente,, Spain

[73] Assignee: Colortex, S.A., Onteniente, Spain

[21] Appl. No.: 656,068

[22] Filed: Feb. 6, 1976

[30] Foreign Application Priority Data

Feb. 6, 1975 Spain ..... 434.507

[51] Int. Cl.[2] ..... B05D 3/00; B05D 5/00

[52] U.S. Cl. ..... 427/276; 26/30; 26/69 B; 156/72; 156/181; 156/209; 156/296; 427/278; 427/285; 427/288; 427/322; 427/323; 427/324; 427/390 R

[58] Field of Search ..... 427/276, 285, 288, 322, 427/323, 324, 278, 390 R; 26/30, 69 B; 156/72, 181, 209, 296

[56] References Cited

U.S. PATENT DOCUMENTS

| | | | |
|---|---|---|---|
| 1,495,141 | 5/1924 | Amory | 26/30 X |
| 2,454,391 | 2/1947 | Jones et al. | 427/278 X |
| 2,819,179 | 1/1958 | Barnard et al. | 427/278 |
| 3,567,548 | 3/1971 | Miller | 156/277 |

*Primary Examiner*—Michael R. Lusignan
*Attorney, Agent, or Firm*—Fleit & Jacobson

[57] ABSTRACT

A process of forming an emboss on textile material such as blankets, bedspreads and the like wherein areas to be unembossed are outlined on the textile material preferably after the textile material has been washed, subsequently treating the outlined areas with a resinous material preferably having additives such as an affixer and a softener which is subsequently permitted to cure and performing a teazeling operation on the textile material to remove the nap from the untreated areas and finally subjecting the teazeled textile material to a finishing operation to provide a smooth teazel nap of the desired length on the textile material.

5 Claims, 2 Drawing Figures

METHOD OF EMBOSSING TEXTILE MATERIAL

BACKGROUND OF THE INVENTION

In certain types of textile products such as blankets, bedspreads and the like, it is frequently highly desirable to provide an embossed surface on such textile products for enhancing their commercial appeal. Such an embossing operation is generally carried out by subjecting the textile material to a teazeling or napping operation to remove the nap or file from specific surface portions of the textile material. It is well known, however, that in such an embossing operation in which the textile material is teazeled or napped, it is extremely difficult to remove such nap or pile from the cloth without effecting the other areas of the textile material thereby producing an embossed product having a finished surface of less than the desired commercial quality.

SUMMARY OF THE INVENTION

Accordingly, a primary object of this invention is to provide a new and novel process for embossing a textile material.

Another object of this invention is to provide a new and novel process of embossing textile material in which the definition between the embossed areas and the unembossed areas is sharply defined.

A further object of this invention is to provide a new and novel method of embossing textile material which permits the use of a teazeling operation which acts on specific areas of the textile material and in which the remaining areas of the textile material are unaffected during the teazeling operation.

This invention contemplates the provision of a new and novel process for embossing textile materials such material used for blankets, bedspreads and the like, which may be carried on in a simple and inexpensive manner, which permits the use of the teazeling operation to form a commercially attractive emboss on the material and which permits the nap or pile to be removed from the textile material in only specific selected areas.

The object of this invention and other related objects are accomplished by providing a textile material having fibers which is preferably first subjected to a washing operation. Selected areas which are not to be embossed are outlined on the textile material and such outlined areas are treated with a resinous material preferably including a softener and an affixer and the resin in the treated areas of the textile material is permitted to cure. A teazeling operation is then performed on the textile material to remove the nap from the untreated areas and the teazeled textile material is then subjected to a finishing operation to provide a smooth teazeled nap of the desired length on the material.

DESCRIPTION OF THE PREFERRED EMBODIMENTS

Figure 1:
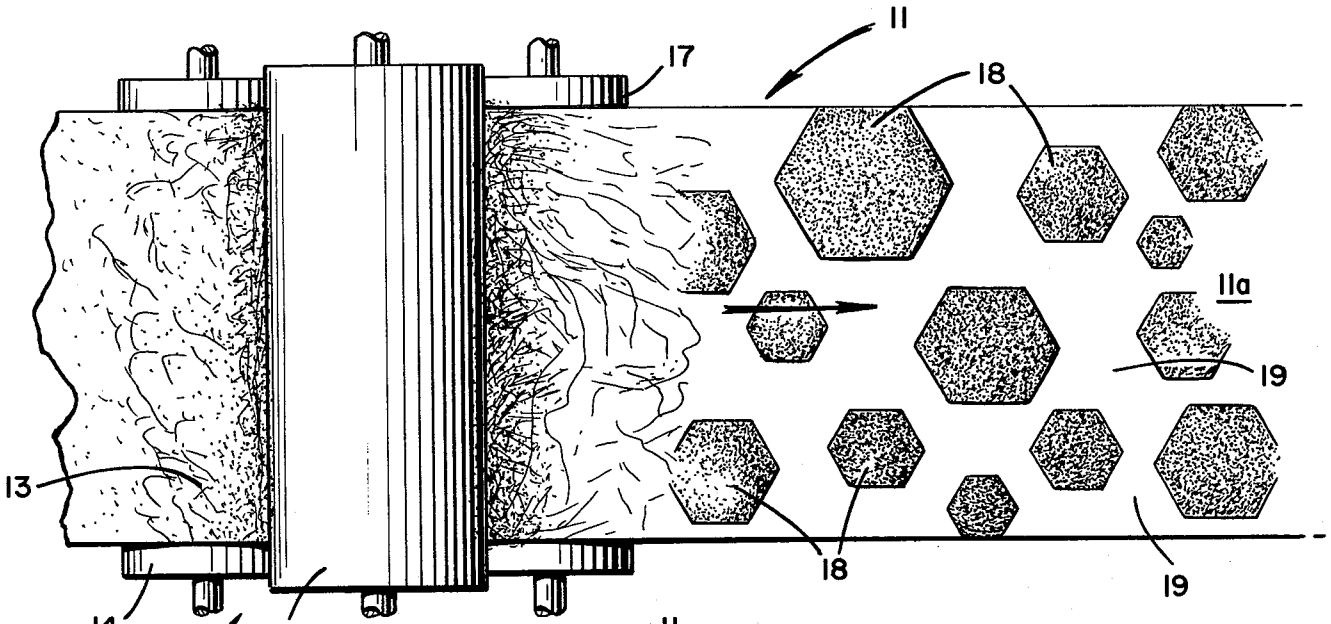
FIG. 1 is a partial plan view of textile material and associated apparatus during the performance of one step in the process of the invention.
Figure 2:
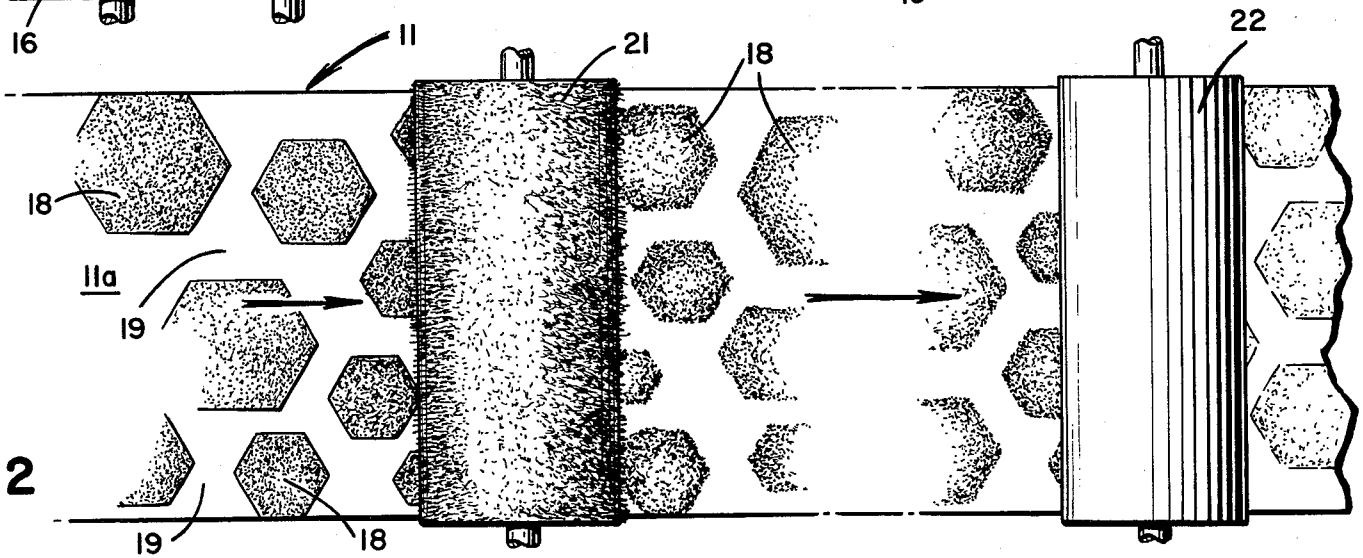
FIG. 2 is a view similar to FIG. 1 showing subsequent steps in the performance of the process of the invention.

In carrying out the process of the invention and refering now to the drawings, textile material which may be of indeterminate length and identified by the numeral 11 is preferably first subjected to a washing step in a conventional manner subsequent to the removal of the textile material from the loom on which it is formed. Such a washing step may be carried out in any suitable apparatus such as a washer 12 containing a washing material 13 and provided with rollers 14, 16, 17, around which the textile material 11 is advanced.

Selected areas of the surface 11*a* of the textile material 11 which are not to be embossed are outlined, such areas being identified by the numeral 18, the remaining areas 19 on the surface 11*a* being those areas which are to form an emboss. It should be understood that the areas 18 which are not to be embossed should be of limited width to avoid tearing of the cloth during the teazeling operation as later described. Also, the width of the areas 18 should vary and additionally, the width of the areas 18 are in a selected direction with respect to the fibers of the textile material 11 such as the direction of the warp, weft or at some angle therebetween.

The outlined areas 18 are then treated with a resinous material perferably an acrylic resin, the resinous material also preferably including an affixer such as a melamine resin and a softener such as a polyethylene emulsion.

The resinous material in the treated areas 18 is then permitted to cure and the surface 11*a* of the textile material containing the areas 18, 19 is subjected to a teazeling or napping operation in a conventional manner utilizing a teazeling device 21. The teazeling or napping operation performed by the teazel 21 subjects the textile material to a napping operation in which the nap or pile is removed from the areas 19 and the teazel 21 does not affect the treated areas 18 since the fibers of the textile material in the areas 18 and matted and stuck together so as to be unaffected by such teazeling.

The resinous material used to treat the areas 18 of the textile material 11 must be carefully selected in order to avoid any excessive rigidity in the areas 18 when the resin cures. If such resinous material becomes very rigid when cured, such rigidity will remain in the textile material and shorten its life due to more rapid deterioration as a result of such rigidity. Furthermore, it should be understood that the textile material can be embossed on both sides which may carry the same pattern or may be of different patterns. As mentioned above, it is preferable to use an acrylic resin to which additives such as an affixer and softener have been added, and which are preferrably a melamine resin and a polyethylene emulsion, respectively.

Subsequent to the teazeling operation on the textile material 11 with the teazel 21, the surface 11*a* of the textile material 11 is then subjected to finishing operations such as a smoothing operation for directing the teazeled nap in the areas 19 or a shearing operation for giving the teazeled nap the desired length. Such a finishing operation may be carried out by an conventional type of device identified by the numeral 22 in the drawings.

What is claimed is:

1. A process of making embossed textile material such as blankets, bedspreads and the like comprising the steps of outlining areas which are not to be embossed on the textile material, treating only said outlined areas with a resinous material, permitting the resin in the treated areas of the textile material to cure, performing a teazeling operation on the textile material to remove the nap from said untreated areas, and subjecting the textile material to a finishing operation to provide a smooth, teazeled nap of the desired length on the material.

2. A process in accordance with claim 1 wherein said resinous material is an acrylic resin.

3. A process in accordance with claim 1 wherein said treating step is carried out with a melamine resin as an affixer.

4. A process in accordance with claim 1 wherein said treating step is carried out with a polyethylene emulsion as a softener.

5. A process is accordance with claim 1 including the steps of limiting the width of said treated areas to avoid damage to the textile material during said teazeling step and varying the width of said treated areas in a selected direction with respect to the fibers of the textile material.

* * * * *